US008844078B2

(12) United States Patent
Hornbach et al.

(10) Patent No.: US 8,844,078 B2
(45) Date of Patent: Sep. 30, 2014

(54) CONTROL OF HOSPITAL BED CHAIR EGRESS CONFIGURATION BASED ON PATIENT PHYSIOLOGY

(71) Applicant: Hill-Rom Services, Inc., Batesville, IN (US)

(72) Inventors: David W. Hornbach, Brookville, IN (US); Aziz A. Bhai, West Chester, OH (US); Christopher R. O'Keefe, Batesville, IN (US); Jason A. Penninger, Indianapolis, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/855,833

(22) Filed: Apr. 3, 2013

(65) Prior Publication Data

US 2013/0219622 A1 Aug. 29, 2013

Related U.S. Application Data

(63) Continuation of application No. 12/951,158, filed on Nov. 22, 2010, now Pat. No. 8,413,273.

(51) Int. Cl.

| | |
|---|---|
| ***A47B 7/00*** | (2006.01) |
| ***A61G 7/012*** | (2006.01) |
| ***A61G 7/018*** | (2006.01) |
| ***A61G 7/16*** | (2006.01) |
| *A61G 7/053* | (2006.01) |
| *A61G 5/00* | (2006.01) |
| *A61G 7/05* | (2006.01) |
| *A61G 7/057* | (2006.01) |

(52) U.S. Cl.

CPC ..... *A61G 7/16* (2013.01); *A61G 2203/16* (2013.01); *A61G 7/053* (2013.01); *A61G 7/012* (2013.01); *A61G 5/006* (2013.01); *A61G 2007/0514* (2013.01); *A61G 7/05769* (2013.01); *A61G 2203/44* (2013.01); *A61G 2007/0524* (2013.01); *A61G 7/018* (2013.01); *A61G 2007/0509* (2013.01)

USPC ..... 5/611; 5/613; 5/618; 5/619

(58) Field of Classification Search

USPC ..... 5/611, 613, 617, 618, 619; 297/63

See application file for complete search history.

(56) References Cited

U.S. PATENT DOCUMENTS 5,060,896 A 10/1991 Hobbins
5,715,548 A 2/1998 Weismiller et al.

(Continued)

FOREIGN PATENT DOCUMENTS

EP 0403073 A2 * 12/1990
EP 0406178 A2 * 1/1991

*Primary Examiner* — Peter M Cuomo
*Assistant Examiner* — Brittany Wilson
(74) *Attorney, Agent, or Firm* — Barnes & Thornburg LLP

(57) ABSTRACT

A patient support apparatus includes a frame having a patient support deck that is movable between a horizontal position to support a patient in a lying position and a chair egress position to support the patient in a sitting position. Depending upon a height of the patient, a lift system is operated to support the patient support deck relative to an underlying floor at different heights when the patient support deck is moved to the chair egress position. Depending upon a weight of the patient, at least one bladder of a mattress is either deflated or further inflated when the patient support deck is moved to the chair egress position and the patient is in the process of egressing from the patient support apparatus.

21 Claims, 8 Drawing Sheets

(56) References Cited

U.S. PATENT DOCUMENTS

| | | | |
|---|---|---|---|
| 5,790,997 | A | 8/1998 | Ruehl |
| 6,056,353 | A | 5/2000 | Meara |
| 6,155,641 | A | 12/2000 | Frost |
| 6,347,420 | B2 | 2/2002 | Elliott |
| 6,516,480 | B2 | 2/2003 | Elliott |
| 6,721,980 | B1 | 4/2004 | Price et al. |
| 7,036,166 | B2 | 5/2006 | Kramer et al. |
| 7,253,366 | B2 | 8/2007 | Bhai |
| 7,296,312 | B2 | 11/2007 | Menkedick et al. |
| 7,319,386 | B2 | 1/2008 | Collins, Jr. et al. |
| 7,330,127 | B2 | 2/2008 | Price et al. |
| 7,458,119 | B2 | 12/2008 | Hornbach et al. |
| 7,512,998 | B2 | 4/2009 | Martin et al. |
| 7,515,059 | B2 | 4/2009 | Price et al. |
| 7,538,659 | B2 | 5/2009 | Ulrich et al. |
| 7,610,638 | B2 | 11/2009 | Kramer et al. |
| 7,644,460 | B2 | 1/2010 | Calvo |
| 7,779,547 | B2 | 8/2010 | Townsend |
| 7,797,771 | B1 | 9/2010 | Bossen et al. |
| 8,028,359 | B2 | 10/2011 | Parson et al. |
| 8,051,512 | B2 | 11/2011 | Teeter |
| 8,127,380 | B2 | 3/2012 | Wurdeman |
| 8,413,273 | B2 | 4/2013 | Hornbach et al. |
| 2004/0189073 | A1 | 9/2004 | Chadwick et al. |
| 2007/0169268 | A1 | 7/2007 | Lemire et al. |
| 2007/0210917 | A1 | 9/2007 | Collins, Jr. et al. |
| 2008/0201851 | A1 * | 8/2008 | Menkedick et al. ..... 5/611 |
| 2009/0000033 | A1 | 1/2009 | Hempker |
| 2009/0038074 | A1 | 2/2009 | Barthelt |
| 2009/0044334 | A1 | 2/2009 | Parsell et al. |
| 2009/0212925 | A1 | 8/2009 | Schuman, Sr. et al. |
| 2009/0212926 | A1 | 8/2009 | Du et al. |
| 2009/0217080 | A1 | 8/2009 | Ferguson et al. |
| 2010/0064439 | A1 | 3/2010 | Sultani |
| 2010/0244522 | A1 | 9/2010 | Fukai |
| 2010/0293718 | A1 | 11/2010 | Wurdeman |
| 2011/0047704 | A1 | 3/2011 | DeBraal et al. |
| 2011/0277242 | A1 | 11/2011 | Dionne et al. |
| 2012/0023673 | A1 | 2/2012 | Hornbach |
| 2012/0047655 | A1 | 3/2012 | O'Keefe |
| 2012/0060290 | A1 | 3/2012 | Jones et al. |

* cited by examiner

CONTROL OF HOSPITAL BED CHAIR EGRESS CONFIGURATION BASED ON PATIENT PHYSIOLOGY

This application is a continuation of U.S. application Ser. No. 12/951,158, which was filed Nov. 22, 2010, which issue issued as U.S. Pat. No. 8,413,273 on Apr. 9, 2013, and which is hereby incorporated by reference herein.

BACKGROUND

The present disclosure relates to patient support apparatuses, such as hospital beds. More particularly, the present disclosure relates to patient support apparatuses having mattress support decks that are movable between horizontal and chair egress positions.

Patient support apparatuses, such as hospital beds, that have articulated decks which move between horizontal and chair egress positions are known. The TOTALCARE® bed marketed by Hill-Rom Company, Inc. is one such bed. Beds are moved to the chair egress position to facilitate a patient's ability to egress from the bed and stand up in a manner similar to standing up from a chair. However, some patients may still have difficulty standing up from beds even when the beds are in the chair egress position. One reason for the difficulty, in some instances, is that the seating surface of the bed in the chair egress position may be too high or too low for the particular patient. In other instances, the difficulty may be created due to a seat region of a mattress being too soft such that the patient's immersion into the seat region presents an egress impediment. Accordingly, a need persists in improving bed features and functions that further facilitate patient egress from beds that have mattress support decks which are movable between horizontal positions and chair egress positions.

SUMMARY

A patient support apparatus, such as a hospital bed, has one or more of the features recited in the appended claims and/or the following features which, alone or in any combination, may comprise patentable subject matter:

A patient support apparatus may include a frame which may have a patient support deck. The patient support deck may be movable between a horizontal position to support a patient in a lying position and a chair egress position to support the patient in a sitting position. The patient support apparatus may also have a lift system that may be operable to support the patient support deck relative to an underlying floor at different heights. A control system may be provided to command operation of the lift system. The control system may receive data indicative of a height of the patient supported on the patient support deck. The control system may determine an elevation at which the lift system may support the patient support deck when the patient support deck is in the chair egress position based on the height of the patient.

The frame may further include a base and an upper frame above the base. The upper frame may support the patient support deck and the upper frame may be supported relative to the base by the lift system. The control system may include a user input that may be used by a caregiver to indicate the height of the patient. For example, the user input may comprise a touchscreen display. The control system may receive data indicative of the height of the patient from a remote computer. The data may be received by the control system via a wired datalink and/or a wireless datalink. The control system may command the lift system to support the patient support deck in the chair egress position at a higher elevation for taller patients and at a lower elevation for shorter patients.

The patient support apparatus may further have a mattress supported on the patient support deck. The mattress may have at least one inflatable bladder in a region of the mattress that supports the patient's buttocks when the patient support deck is in the chair egress position supporting the patient in the sitting position. The control system may have a pneumatic control system portion that may be operable to inflate and deflate the at least one inflatable bladder. The control system may determine whether to deflate the at least one inflatable bladder when the patient support deck is in the chair egress position based on a weight of the patient. In some embodiments, the frame may include at least one sensor, such as a load cell, that provides a signal to the control system indicative of the weight of the patient. Alternatively or additionally, the control system may receive data indicative of the weight of the patient from a remote computer.

According to this disclosure, the control system may determine whether to further inflate the at least one inflatable bladder when the patient support deck is in the chair egress position based on the weight of the patient. For example, the at least one inflatable bladder may be deflated when the patient support deck is in the chair egress position supporting the patient in the sitting position and the patient's weight is below a threshold amount of weight. On the other hand, the at least one inflatable bladder may be further inflated when the patient support deck is in the chair egress position supporting the patient in the sitting position if the patient's weight is above the threshold amount of weight.

In some embodiments, the control system may include a patient position monitoring system to monitor a position of the patient on the patient support deck. The control system may determine whether to deflate the at least one inflatable bladder when the patient support deck is in the chair egress position based on the weight of the patient and based on the position of the patient. For example, if the weight of the patient is below a threshold weight, then the control system may signal the pneumatic control system portion to maintain inflation of the at least one inflatable bladder if the patient position monitoring system indicates that the patient is reclined on the patient support deck when the patient support deck is in the chair egress position. On the other hand, if the weight of the patient is below the threshold weight, then the control system may signal the pneumatic control system portion to deflate the at least one inflatable bladder if the patient position monitoring system indicates that the patient is moving toward egressing from the patient support deck when the patient support deck is in the chair egress position. In some embodiments, if the weight of the patient is below the threshold angle, then the control system may signal the pneumatic control system portion to re-inflate the at least one inflatable bladder after the patient has egressed from the patient support deck by a threshold amount as determined by the patient position monitoring system.

According to this disclosure, therefore, a patient support apparatus may have a frame that may include a patient support deck. The patient support deck may be movable between a horizontal position to support a patient in a lying position and a chair egress position to support the patient in a sitting position. A mattress may be supported on the patient support deck. The mattress may have at least one inflatable bladder in a region of the mattress that supports the patient's buttocks when the patient support deck is in the chair egress position supporting the patient in the sitting position. The patient support apparatus may further have a control system that may be operable to control the inflation and deflation of the at least one inflatable bladder. The control system may receive data indicative of a weight of the patient supported on the patient support deck. The control system may operate to further inflate the at least one inflatable bladder when the patient support deck is in the chair egress position and the weight of the patient is above a threshold weight. The control system may operate to deflate the at least one inflatable bladder when the patient support deck is in the chair egress position and the weight of the patient is below the threshold weight.

The weight of the patient may be communicated to the control circuitry by at least one of a remote computer and a scale system coupled to the frame of the patient support apparatus. In some embodiments, the control system may include a patient position monitoring system to monitor a position of the patient on the patient support deck. If the weight of the patient is below the threshold weight, then the control system may operate to maintain inflation of the at least one inflatable bladder if the patient position monitoring system indicates that the patient is reclined on the patient support deck when the patient support deck is in the chair egress position. If the weight of the patient is below the threshold weight, then the control system may operate to deflate the at least one inflatable bladder if the patient position monitoring system indicates that the patient is moving toward egressing from the patient support deck when the patient support deck is in the chair egress position.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

According to this disclosure, a patient support apparatus, such as an illustrative hospital bed 10, has lift system features and functions and/or mattress pneumatic control system features and functions that assist a patient in standing up from the bed 10 when the bed 10 is in a chair egress mode. Depending upon a patient's height and/or weight, the lift system and/or pneumatic control system are operated differently during the chair egress mode as will be discussed in further detail below.

Figure 1:
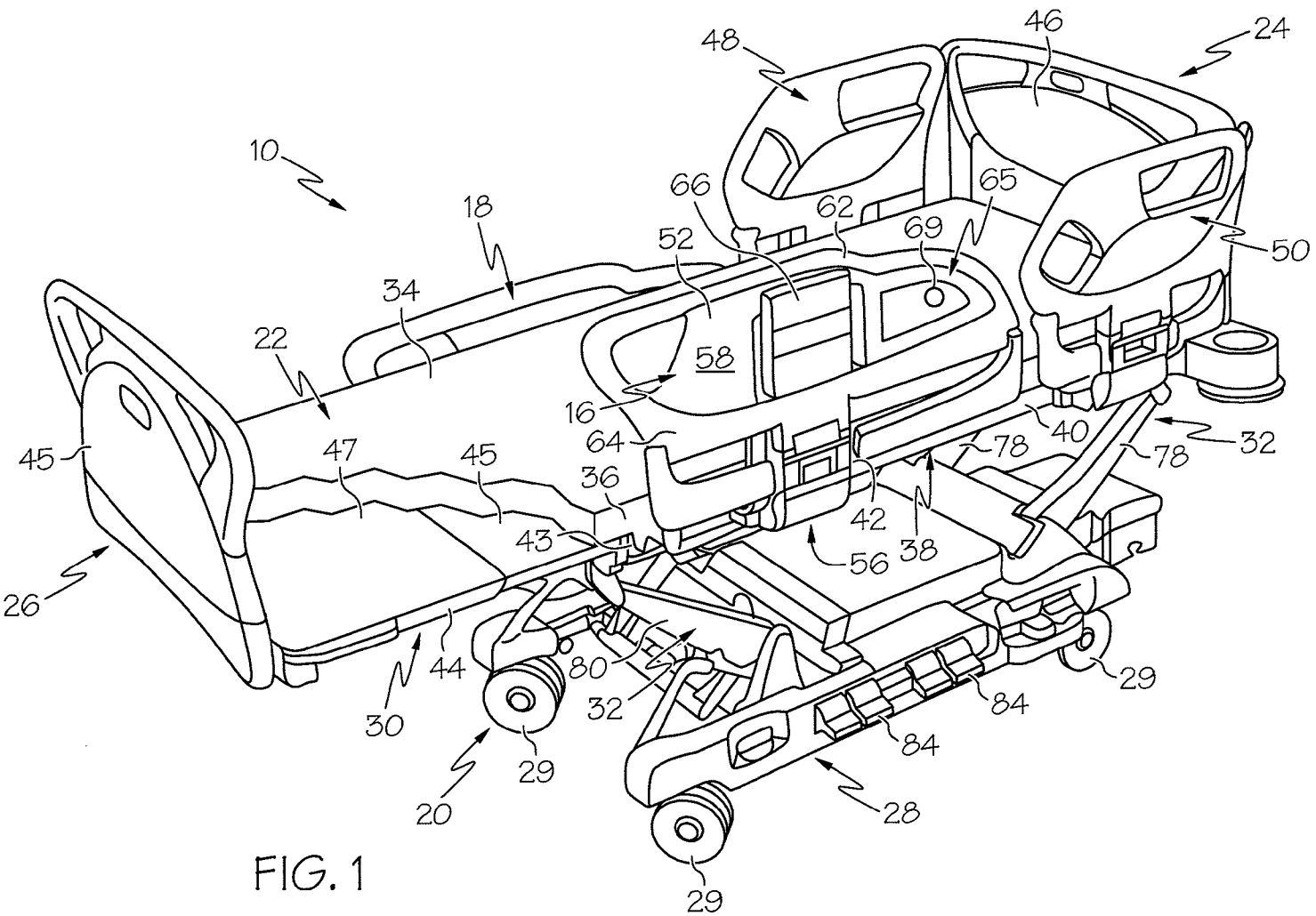
FIG. 1 is a perspective view of a hospital bed having a patient support deck in a horizontal position and having three of four siderails in a raised position with a fourth of the four siderails in a lowered position.
Figure 2:
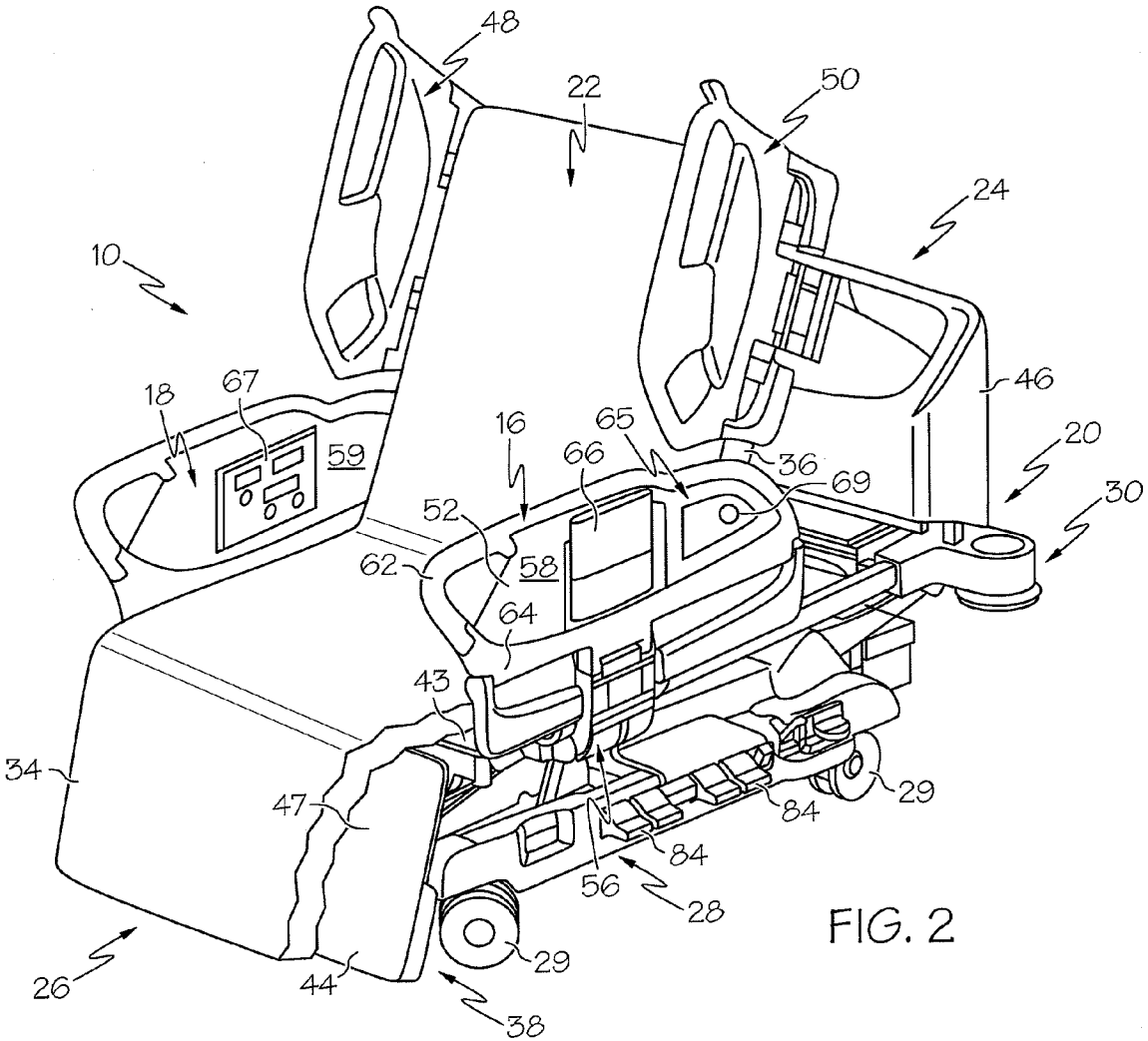
FIG. 2 is a perspective view of the hospital bed of FIG. 1 having the patient support deck in a chair egress position.

Illustrative bed 10 is a so-called chair bed that is movable between a bed position as shown in FIG. 1 and a chair egress position as shown in FIG. 2. However, the teachings of this disclosure are applicable to other types of patient support apparatuses such as stretchers, motorized chairs, operating room (OR) tables, and specialty surgical tables such as orthopedic surgery tables, examination tables, and the like.

Referring now to FIGS. 1 and 2, hospital bed 10 provides support to a patient (not shown) lying in a horizontal position when bed 10 is in the bed position shown in FIG. 1 and hospital bed 10 supports the patient in a sitting position such that the patient sits on bed 10 with the patient's feet positioned on an underlying floor when bed 10 is in the chair egress position shown in FIG. 2. Thus, the chair egress position is often used by patients and caregivers to help patients egress or exit the hospital bed 10. Hospital bed 10 includes a frame 20 that supports a mattress 22 as shown in FIGS. 1 and 2. Bed 10 has a head end 24 and a foot end 26.

Frame 20 includes a base 28 and an upper frame 30 coupled to the base 28 by a lift system 32. Lift system 32 is operable to raise, lower, and tilt upper frame 30 relative to base 28. Hospital bed 10 further includes a footboard 45 at the foot end 26 and a headboard 46 at the head end 24. Footboard 45 is removed prior to bed 10 being moved into the chair egress position as shown in FIG. 2. Base 28 includes wheels or casters 29 that roll along the floor as bed 10 is moved from one location to another.

Illustrative hospital bed 10 has four siderail assemblies coupled to upper frame 30: a patient-right head siderail assembly 48, a patient-right foot siderail assembly 18, a patient-left head siderail assembly 50, and a patient-left foot siderail assembly 16. Each of the siderail assemblies 16, 18, 48, and 50 is movable between a raised position, as the left foot siderail assembly 16 is shown in FIG. 1, and a lowered position, as the right foot siderail assembly 18 is shown in FIG. 1. Siderail assemblies 16, 18, 48, 50 are sometimes referred to herein as siderails 16, 18, 48, 50.

The left foot siderail assembly 16 is similar to the other siderail assemblies 18, 48, 50, and thus, the following discussion of the left foot siderail assembly 16 is equally applicable to the other siderail assemblies 18, 48, 50 unless specifically noted otherwise. The left foot siderail 16 includes a barrier panel 52 and a linkage 56. Linkage 56 is coupled to the upper frame 30 and is configured to guide barrier panel 52 during movement of the foot siderail 16 between the raised and lowered positions. Barrier panel 52 is maintained by the linkage 56 in a substantially vertical orientation during movement of siderail 16 between the raised and lowered positions. The barrier panel 52 includes an outward side 58, an oppositely facing inward side 59, a top portion 62, and a bottom portion 64.

A graphical user interface 66 is coupled to the outward side 58 of barrier panel 52 for use by a caregiver (not shown). The inward side 59 faces opposite the outward side 58. As shown in FIG. 2, another user interface 67 is coupled to the inward side 59 for use by the patient. In the illustrative embodiment, user interface 66 comprises a touchscreen display. Also in the illustrative embodiment, a separate caregiver user interface 65 is provided on the outward side 58 of barrier panel 52. User interface 65 includes a variety of buttons, such as membrane switches, for example, that are used to control various bed functions. Additional details of user interface 65 are provided in U.S. application Ser. No. 12/891,909 which is titled "Hospital Bed with Chair Lockout," which was filed Sep. 28, 2010, and which is hereby incorporated by reference herein. For purposes of this disclosure, however, it is notable that user interface 65 includes a chair egress mode button 69 as shown generically in FIGS. 1 and 2.

Figure 3:
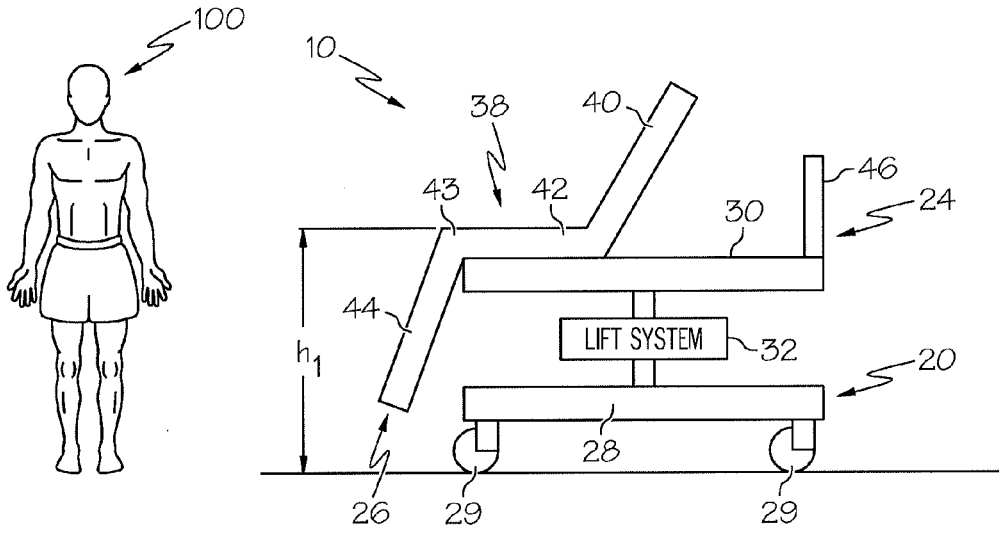
FIG. 3 is a diagrammatic side view of the hospital bed of FIGS. 1 and 2 showing a lift system supporting an upper frame and the patient support deck at a high elevation in the chair egress position to accommodate a tall patient.
Figure 4:
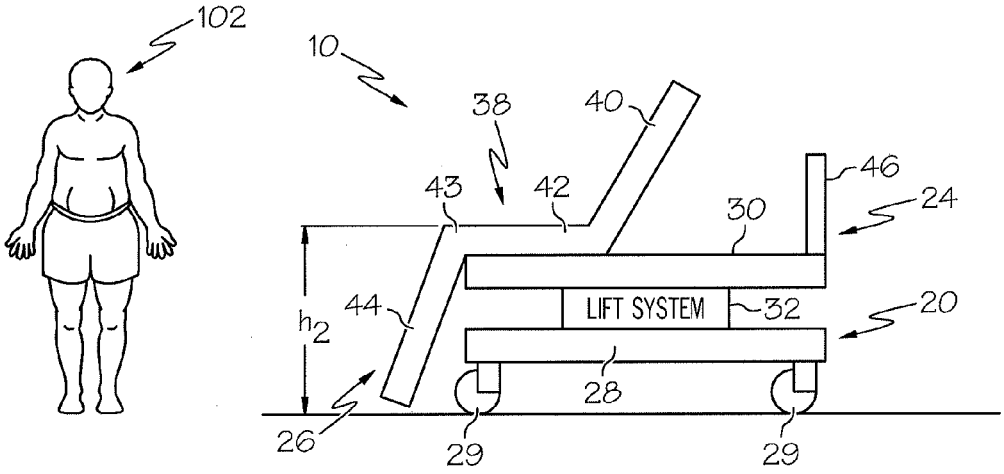
FIG. 4 is a diagrammatic side view, similar to FIG. 3, showing the lift system supporting the upper frame and the patient support deck at a low elevation in the chair egress position to accommodate a short patient.

Mattress 22 includes a top surface 34, a bottom surface (not shown), and a perimeter surface 36 as shown in FIGS. 1 and 2. The upper frame 30 carries a mattress support deck 38 of frame 20 that engages the bottom surface of mattress 22. The support deck 38, as shown for example in FIG. 2 and as shown diagrammatically in FIGS. 3 and 4, includes a head section 40, a seat section 42, a thigh section 43 and a foot section 44. Each of sections 40, 43, 44 is movable relative to upper frame 30. For example, in a first embodiment, head section 40 pivotably raises and lowers relative to seat section 42 whereas foot section 44 pivotably raises and lowers relative to thigh section 43. Additionally, thigh section 43 articulates relative to seat section 42. Also, in the illustrative embodiment of FIGS. 1 and 2, foot section 44 is extendable and retractable to change the overall length of foot section 44 and therefore, to change the overall length of deck 38. For example, in the illustrative embodiment, foot section 44 includes a main portion 45 and an extension 47 as shown in FIG. 1. In some embodiments, seat section 42 is also movable relative to upper frame 30 such as by pivoting and/or translating relative to upper frame 30.

As bed 10 moves from the bed position to the chair egress position, foot section 44 lowers relative to thigh section 43 and shortens in length due to retraction of the extension 47 relative to main portion 45. As bed 10 moves from the chair egress position to the bed position, foot section 44 raises relative to thigh section 43 and increases in length due to extension of the extension 47 relative to main portion 45. Thus, in the chair egress position, head section 40 extends generally vertically upwardly from upper frame 30 and foot section extends generally vertically downwardly from thigh section 43 as shown in FIG. 2 and as shown diagrammatically in FIGS. 3 and 4. In the bed position, mattress support deck 38 and upper frame 30 are in a horizontal position.

As mentioned previously, lift system 32 is operable to raise, lower, and tilt upper frame 30 relative to base 28. In the illustrative embodiment, lift system 32 includes a set of head end lift arms 78 and a set of foot end lift arms 80 (only one of which can be seen in FIG. 1) to accomplish the raising, lowering and tilting functions of upper frame 30 relative to base 28. As bed 10 moves from the horizontal bed position of FIG. 1 to the chair egress position of FIG. 2, motors or actuators (not shown) are operated to move arms 78, 80 to lower upper frame 30 toward base 20 if frame 30 is in a raised position initially.

In the illustrative example, bed 10 has four foot pedals 84 coupled to base 28 on each side of base 28. A first of pedals 84 is depressed to raise upper frame 30 relative to base 28, a second of pedals 84 is used to lower frame 30 relative to base 28, a third of pedals 84 is used to raise head section 40 relative to upper frame 30, and a fourth of pedals 84 is used to lower head section 40 relative to upper frame 30. In other embodiments, foot pedals 84 are omitted.

It should be appreciated by those skilled in the art that bed 10 includes various actuators or motors (not shown) to move lift arms 78, 80 of lift system 32, to move sections 40, 43, 44 relative to upper frame 30, and to move section 42, as well, in those embodiments in which section 42 moves relative to upper frame 30. For example, it is well known in the hospital bed art that electric drive motors with various types of transmission elements including lead screw drives and various types of mechanical linkages may be used to cause relative movement of portions of patient support apparatuses including raising, lowering, or tilting one portion of a bed relative to another. It is also well known to use pneumatic or hydraulic actuators to actuate and/or move individual portions of patient support apparatuses. As a result, the terms "actuator (s), "motor(s)," "lift system," "elevation system" and similar such words as used in the specification and in the claims, therefore, are intended to cover all types of mechanical, electromechanical, hydraulic and pneumatic mechanisms, including manual cranking mechanisms of all types, for raising or lowering or tilting portions of patient support apparatuses, such as illustrative hospital bed 10, relative to other portions. For example, lift systems using scissors linkage arrangements or using vertically oriented telescoping structures, such as hydraulic cylinders or jack screws, are within the scope of this disclosure. As another example, electrically powered linear actuators to articulate deck sections 42, 43, 44 and to pivot arms 78, 80 are also within the scope of this disclosure.

Depending upon the height of the patient, the lift system 32 is operated so that a seating surface of deck 38, which for purposes of this discussion is arbitrarily defined by the upper surfaces of seat and thigh sections 42, 43, are moved to various target heights above the underlying floor when deck 38 is moved into the chair egress position. In other embodiments, a hospital bed may have only three deck sections such that the upper surface of only the middle or seat section may be considered to arbitrarily define the seating surface when the 3-section deck is moved into a chair egress position. To illustrate this general concept, in FIG. 3, a tall patient 100 is shown adjacent bed 10 and lift system 32 has been controlled so that the seating surface is located at a first height, h1, above the floor and, in FIG. 4, a short patient 102 is shown adjacent bed 10 and lift system 32 has been controlled so that the seating surface is located at a second height, h2, above the floor. Height h1 is the programmed height for the tall patient and is greater than h2 which is programmed for the short patient. Thus, for tall patients, lift system 32 is operated to place upper frame 30 and sections 42, 43 at an elevation which is higher than for short patients. While patients 100, 102 are shown next to bed 10 in FIGS. 3 and 4, it should be understood that bed 10 is typically moved into the chair egress position while the patients are supported by mattress 22 on deck 38.

In some embodiments, the height of the seating surface generally corresponds to the popliteal height of the corresponding patient. The popliteal height is the height from the floor, when the patient's feet are placed flat on the floor, up to the patient's popliteal, which is the part of the leg that bends behind the knee. The illustrative heights h1 and h2 are simply two discrete elevations corresponding to patients having two discrete heights. However, it is contemplated by this disclosure that a spectrum of seating surface heights is achievable when bed 10 is in the chair egress position depending upon the height of the associated patient.

Because male and female adult patient heights fall generally into respective Gaussian distributions, lift system control algorithms according to this disclosure may account for a large percentage, such as 90% for example, of the patient population such that a maximum seating surface height corresponds to patients at the $95^{th}$ percentile in height and such that the minimum seating surface height corresponds to patients at the $5^{th}$ percentile in height. A linear correlation, or other mathematical correlation if desired or appropriate, is then used to establish the seating surface height when bed 10 is in the chair egress position. This is not to say that algorithms that account for a greater percentage or lesser percentage than 90% of the height of any given patient population are outside the scope of this disclosure. In the United States, however, it is generally known that the popliteal height of a male at the $95^{th}$ percentile of height is about 490 millimeters (mm) (or 19.3 inches) and the popliteal height of a female at the $5^{th}$ percentile of height is about 355 mm (or 14.0 inches). In some embodiments, therefore, lift system 32 is operable to place the seating surface at heights between about 19.3 inches and about 14.0 inches depending upon the height of the associated patient.

In some embodiments, it is assumed that there is a linear or proportional correlation between overall patient height and the popliteal height. In such embodiments, a straight correlation curve or equation results for determining seating surface height when bed 10 is in the chair egress position. In some embodiments, a look up table may be programmed into the algorithm rather than using a curve or formula. In some contemplated embodiments, different correlation curves, equations, and/or look up tables may be programmed for male patients and female patients, if desired, based on the anthropometric data for these two populations. Alternatively or additionally, it is also within the scope of this disclosure for different correlation curves to be programmed based on a comparison of popliteal height to overall height for different races and/or ethnicities. In such embodiments, in addition to the height data, a caregiver either enters data regarding the patient's sex, race, and/or ethnicity into the control system of bed 10 or such data is transmitted to the control system of bed 10 from a remote computer device, such as a computer device of an electronic medical records (EMR) system.

In some embodiments, an offset from the popliteal height may be included as part of the algorithm for determining seating surface height when bed 10 is in the chair egress position. For example, having the seating surface 1 or 2 inches, or more, below the popliteal height when bed 10 is in the chair egress position so that the patient can bend their legs at the knee more than 90 degrees prior to standing up from bed 10 may be desired in some instances. In other instances, it may be desired to have the seating surface 1 or 2 inches, or more, above the popliteal height when bed 10 is in the chair egress position so that the patient does not need to bend their legs at the knee quite as much while standing up from the bed 10. One such instance may occur, for example, if the patient has had knee surgery and is unable to bend their legs at the knee more than 90 degrees. The offset from the popliteal height may be selectable on graphical user interface 66 in some embodiments.

In the discussion above, the height or elevation of the seating surface from the floor was said to be the arbitrarily chosen distance of interest. However, the height above the floor of some other arbitrary reference point or plane on bed 10, when bed 10 is in the chair egress position, may be monitored or calculated just as well. For example, the top or bottom surface of upper frame 30 could be chosen as the reference point or plane. Furthermore, the distance of the reference point or plane of some portion of the upper frame 30 or deck 38 above some other reference point or plane on base 28, rather than the floor, may be the distance that is monitored or calculated in some embodiments. Regardless of whether the position of upper frame 30 relative to base 28 is controlled based on patient height, or whether some other distance is controlled, the end result is that the seating surface height above the floor is varied based on patient height.

The actuators or motors that move lift arms 78, 80 of lift system 32 have sensors, such as rotary potentiometers in some embodiments, and the signals from the sensors are used to determine the height of upper frame 30 relative to base. In other embodiments, the sensors may include accelerometers or inclinometers on lift arms 78, 80 which provide signals indicative of the angle of lift arms 78, 80 relative to vertical or horizontal or relative to some other reference plane. Based on the information regarding the angle of lift arms 78, 80, the height of upper frame 30 above base 28 can be determined. Additional sensors may be provided on base 28 and/or upper frame 28 to indicate whether these portions of bed are at an angle other than horizontal such as will be the case with base 28 when bed 10 is being pushed up or down a ramp.

Figure 5:
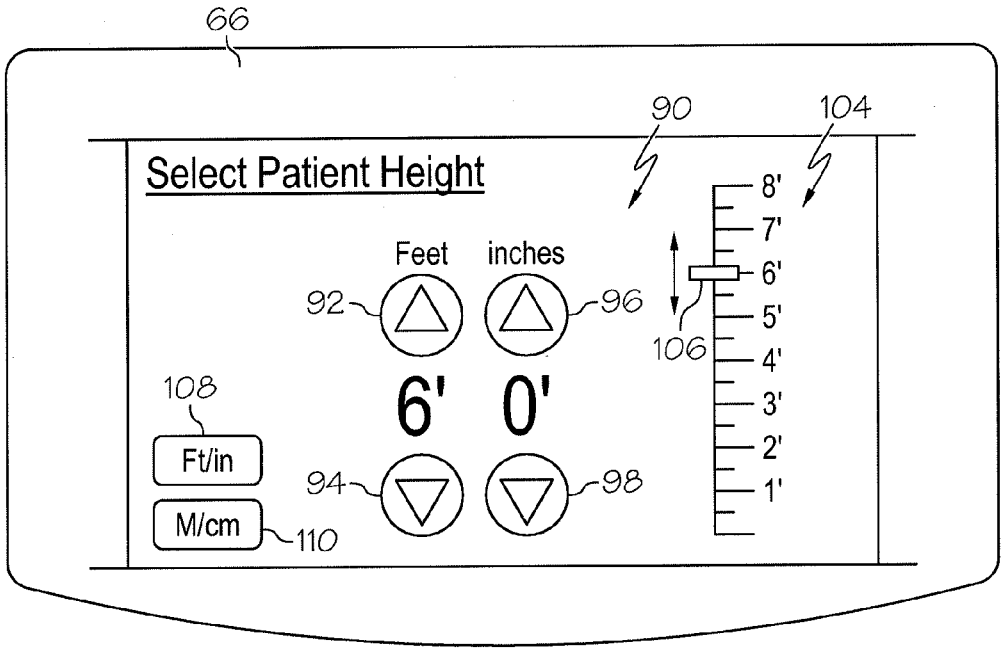
FIG. 5 is a front elevation view of a graphical user interface having buttons or icons that are used to enter a patient's height into a control system of the hospital bed.

Referring now to FIG. 5, a Select Patient Height screen 90 shown on graphical user interface 66 has a feet up button 92, a feet down button 94, an inch up button 96, and an inch down button 98 which are touched by a caregiver to enter a patient's height into the control system of the hospital bed. In the illustrative example, a bar graph 104 with a slider icon 106 is also shown on screen 90. Icon 106 appears on graph 104 at the position corresponding to the height selected by the caregiver using buttons 92, 94, 96, 98. In some embodiments, the caregiver is able to touch and drag icon 106 along graph 104 to change the height setting.

In the illustrative embodiment, a Ft/in button 108 and a M/cm button 110 is provided to permit toggling between feet/inch units and meter/centimeter units. In the illustrative example, feet/inch units have been chosen so the patient's height in feet and inches are shown on screen 90. The feet value is shown between buttons 92, 94 and the inch value is shown between buttons 96, 98. Also, the gradations on graph 104 are in feet/inches. In response to selecting M/cm button 110, a meter value is shown between buttons 92, 94, a centimeter value is shown between buttons 96, 98, and the gradations on graph 104 switch to meters/centimeters.

After the caregiver selects the patient's height using buttons 92, 94, 96, 98 or slider 106, the user double taps a blank area on screen 90 in some embodiments to store the selected height in memory of the control system of bed 10. In other embodiments, screen 90 includes an enter button that is touched for this purpose. Alternatively or additionally, if the caregiver does not touch any of buttons 92, 94, 96, 98, 108, 110 or slider 106 for a threshold amount of time, such as 10 or 15 seconds, for example, then the height value shown on screen 90 is stored in memory of the control system.

Figure 6:
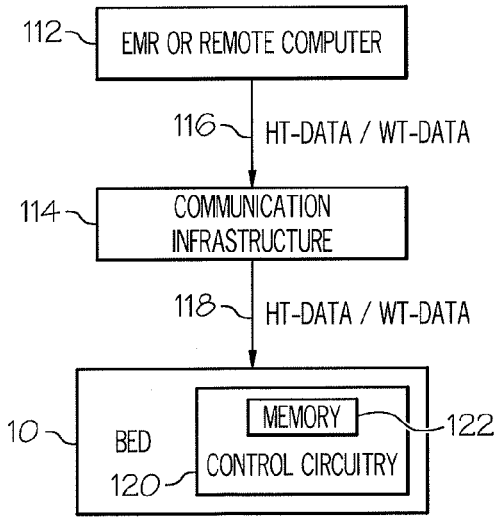
FIG. 6 is a block diagram showing a patient's height data and/or weight data being communicated to the hospital bed from a remote computer.

It is also contemplated by this disclosure that, in some embodiments, the patient's height data and/or weight data is transmitted to bed 10 from a remote computer or system, such as a computer 112 of an electronic medical records (EMR) system, via communication infrastructure 114 and data links 116, 118 as shown diagrammatically in FIG. 6. At bed 10, the patient's height data is stored in memory 122 of control circuitry 120 regardless of whether the height data is transmitted to bed 10 or whether a caregiver has entered the data on screen 90. In the illustrative embodiment, bed 10 includes a scale system 136 as will be discussed in further detail below. The scale system 136 is able to measure the patient's weight and then the measured weight is stored in memory 122 of control circuitry 120. In the illustrative example, scale system 136 also functions as a patient position monitoring (PPM) system and so is indicated as scale/PPM system 136 in FIGS. 11-13. In other embodiments, weight data is transmitted to bed 10 from a remote computer 112 as previously mentioned. In other contemplated systems, computer 112 is part of a nurse call system, a physician ordering system, an admission/discharge/transfer (ADT) system, or some other system used in a healthcare facility. Communication infrastructure 114 in FIG. 6 is illustrated diagrammatically and is intended to represent all of the other hardware and software that comprises a network of a healthcare facility.

Data links 116, 118 are wired communications links and/or wireless communication links. For example, communications link 118, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which are hereby expressly incorporated by reference herein. In other embodiments, communications link 118 comprises wireless signals sent between bed 10 and a wireless interface unit of the type shown and described in U.S. Patent Application Publication No. 2007/0210917 A1 which is hereby expressly incorporated by reference herein. Communications link 116 also comprises one or more wired links and/or wireless links as previously noted.

In some embodiments, bed 10 includes a pneumatic control system 124 that controls inflation and deflation of various air bladders or cells of mattress 22. As shown diagrammatically in FIGS. 7-9 and 11-13, mattress 22 of bed 10 has a set of head zone bladders 126, a set of seat and thigh zone bladders 128 (sometimes referred to herein as just "seat zone bladders 128"), and a set of foot zone bladders 130. Bladders 126, 128, 130 are coupled to the pneumatic control system 124 via respective pneumatic lines 132, 134, 136 which comprise flexible tubes or hoses, for example. Pneumatic control system 124 is illustrated diagrammatically and is intended to represent the various components such as one or more air sources including compressors, blowers, fans, pressure reservoirs, and the like; one or more manifolds; one or more valves; one or more pressure sensors; and the associated circuitry that controls the inflation and deflation of bladders 126, 128, 130. Pneumatic control system 124 is in electrical communication with the main control circuitry 120 of bed 10 as indicated diagrammatically by communications link 142. In the illustrative example, communications link 142 is a bidirectional communications link.

Figure 7:
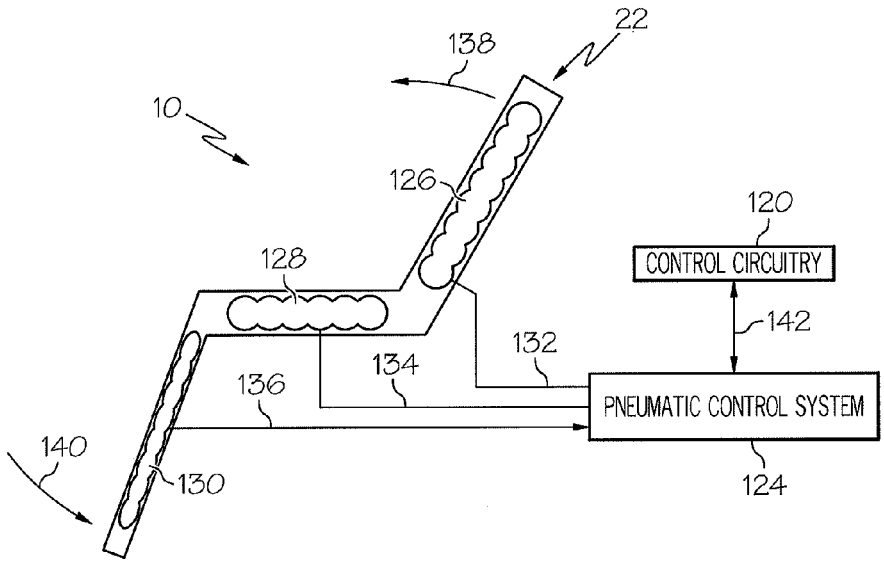
FIG. 7 is a diagrammatic view of a mattress of the hospital bed showing a pneumatic control system being commanded by control circuitry to deflate one or more air bladders of a foot section of the mattress in connection with the mattress moving into the chair egress position.

According to this disclosure, as deck 38 moves into the chair egress position, head section 40 raises as indicated by arrow 138 in FIG. 7 and foot section 44 lowers as indicated by arrow 140 in FIG. 7. Of course, the portions of mattress 22 supported by deck sections 40, 44 raise and lower along with the respective deck sections 40, 44 in directions 138, 140, respectively. As foot section 44 lowers, pneumatic control system 124 is operated to deflate the set of foot zone bladders 130 such that air is evacuated from bladders 130 via line 136 as shown in FIG. 7. In some embodiments, pressure adjustments are also made in seat zone bladders 128 and/or head zone bladders 126. For example, bladders 128 are further inflated in some embodiments to prevent or lessen the chance of the patient bottoming out on the seat section 42 of deck 38. Bottoming out refers to the situation in which a patient completely crushes or deforms a mattress bladder to the extent that the patient feels the underlying deck section.

Figure 8:
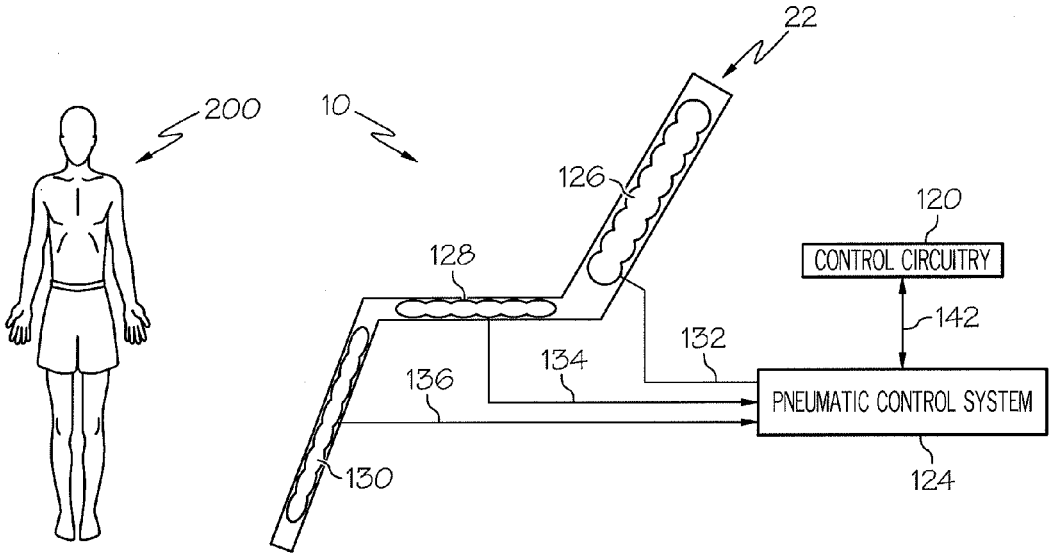
FIG. 8 is a diagrammatic view of the mattress, similar to FIG. 7, showing the pneumatic control system being commanded by the control circuitry to deflate one or more aid bladders of a seat section of the mattress to accommodate a low weight patient during the patient's egress from the hospital bed.
Figure 9:
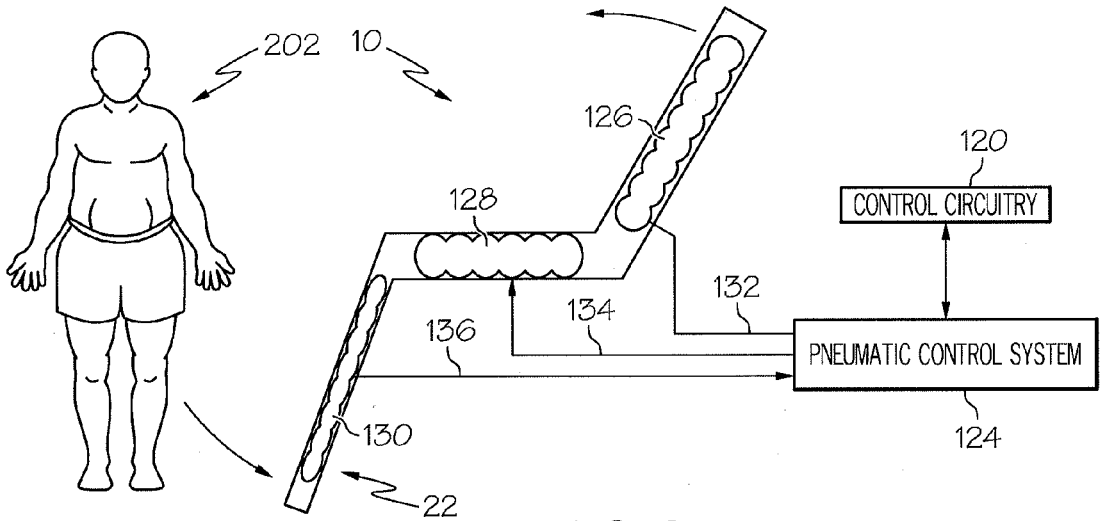
FIG. 9 is a diagrammatic view of the mattress, similar to FIGS. 7 and 8, showing the pneumatic control system being commanded by the control circuitry to further inflate one or more aid bladders of the seat section of the mattress to accommodate a high weight patient during the patient's egress from the hospital bed.

The state of inflation and deflation of bladders 126, 128, 130 shown in FIG. 7 corresponds to the situation in which bed 10 is moved to the chair egress position and the patient intends to remain sitting in the bed 10 for some period of time. When it is time for the patient to stand up from bed 10, the caregiver presses or touches chair egress button 69 of user interface 65 to activate the chair egress mode of bed 10. Depending upon the weight of the patient, the pneumatic control system 124 operates either to deflate seat zone bladders 128 for lighter patients as shown in FIG. 8 or to further inflate seat zone bladders 128 for heavier patients as shown in FIG. 9. Thus, to further illustrate this general concept, in FIG. 8, a light weight patient 200 is shown adjacent bed 10 and system 124 has been operated so that seat zone bladders 128 are deflated via line 134 and, in FIG. 9, a heavy weight patient 202 is shown adjacent bed 10 and system 124 has been operated so that seat zone bladders 128 are further inflated via line 134.

Figure 10:
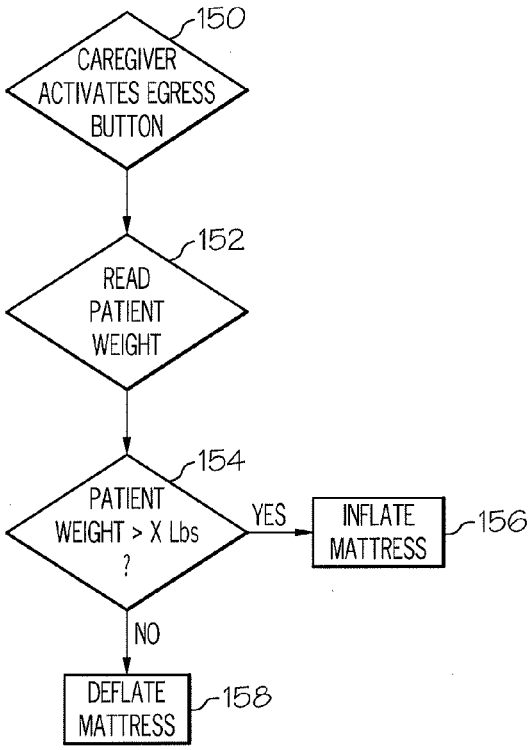
FIG. 10 is a flow chart showing an algorithm that is executed by the control circuitry in determining whether to deflate or further inflate the one or more seat section bladders in response to a caregiver activating an egress button.

A block diagram illustrative of the algorithm executed by the control system of bed 10 to determine whether to deflate or further inflate bladders 128 in response to the activation of chair egress button 69 is shown in FIG. 10. The control circuitry 120, pneumatic control system 124, and scale/PPM system 136, either individually or together, are considered to be a control system of bed 10 according to this disclosure. The control system of bed 10 includes additional circuitry in some embodiments, such as power control circuitry, battery recharging circuitry, and so forth. Thus, a control system of a patient support apparatus, such as bed 10, is considered to be some or all of the electrical hardware and software that controls, operates, or is associated with any of the functions of the patient support apparatus.

The algorithm of FIG. 10 begins as a result of the caregiver pressing or activating the chair egress button 69 as indicated at block 150. After the button 69 is pressed, the control system of bed 10 reads the patient weight as indicated at block 152. The control system then compares the patient's weight to a threshold value, X, as indicated at block 154. If the patient's weight is above the threshold amount of weight, then bladders 128 are further inflated as indicated at block 156. If the patient's weight is equal to or below the threshold amount of weight, then bladders 128 are deflated as indicated at block 158. Regardless of whether bladders 128 are deflated or further inflated in response to the chair egress button 69 being activated, the result is that the surface on which the patient is sitting just prior to egressing from bed 10 is made firmer, thereby making it easier for the patient to get up out of the bed. Thus, the patient's immersion into the seat region, which as mentioned previously presents an egress impediment in some prior art beds, is lessened or substantially eliminated by further inflating bladders 128 or by deflating them.

The threshold amount of weight for determining whether to deflate or further inflate bladders 128 may be in the range of 200 to 300 pounds in some embodiments, for example. Thresholds that are greater than or lesser than this range are within the scope of this disclosure. The threshold amount of weight is at the discretion of the system designer and/or programmer and is dependent upon a number of factors including, for example, whether there is a base foam layer or some other cushioning element beneath or atop bladders 128. In any event, lighter patients are thought to be able to withstand the bottoming out that occurs as result of deflating bladders 128 better than heavier patients because lighter patients will have less weight bearing upon the skin tissue of the buttocks region which reduces the chances that lighter patients will develop pressure sores or decubitus ulcers when supported on a hard surface. In some embodiments, for heavier patients, bladders 128 may remain at their current level of inflation rather than being further inflated.

Figure 11:
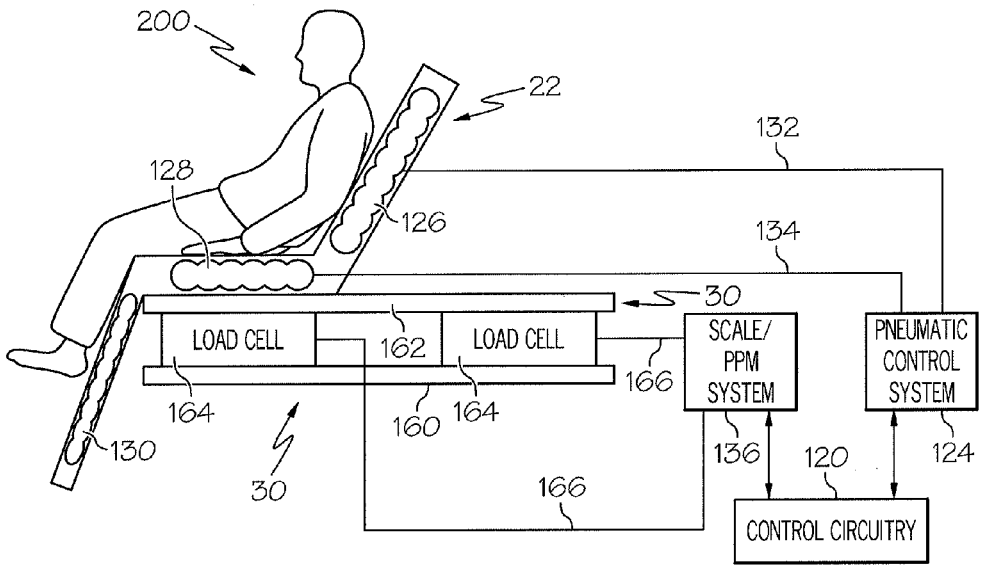
FIG. 11 is a diagrammatic view showing the mattress in the chair egress position supported on the upper frame, the upper frame including a set of load cells that provide signals to a scale/patient position monitoring (PPM) system, and the one or more bladders of the seat section being inflated because the scale/PPM system senses that the patient is reclining on the mattress of the hospital bed.
Figure 12:
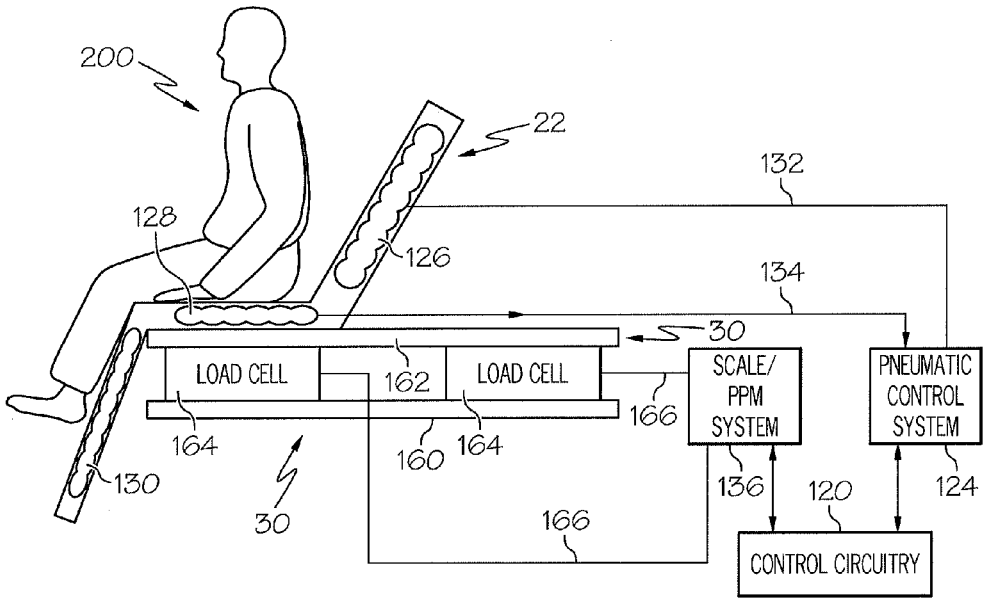
FIG. 12 is a diagrammatic view, similar to FIG. 11, showing the one or more bladders of the seat section being deflated because the scale/PPM system senses that the patient is moving toward egressing from the hospital bed.
Figure 13:
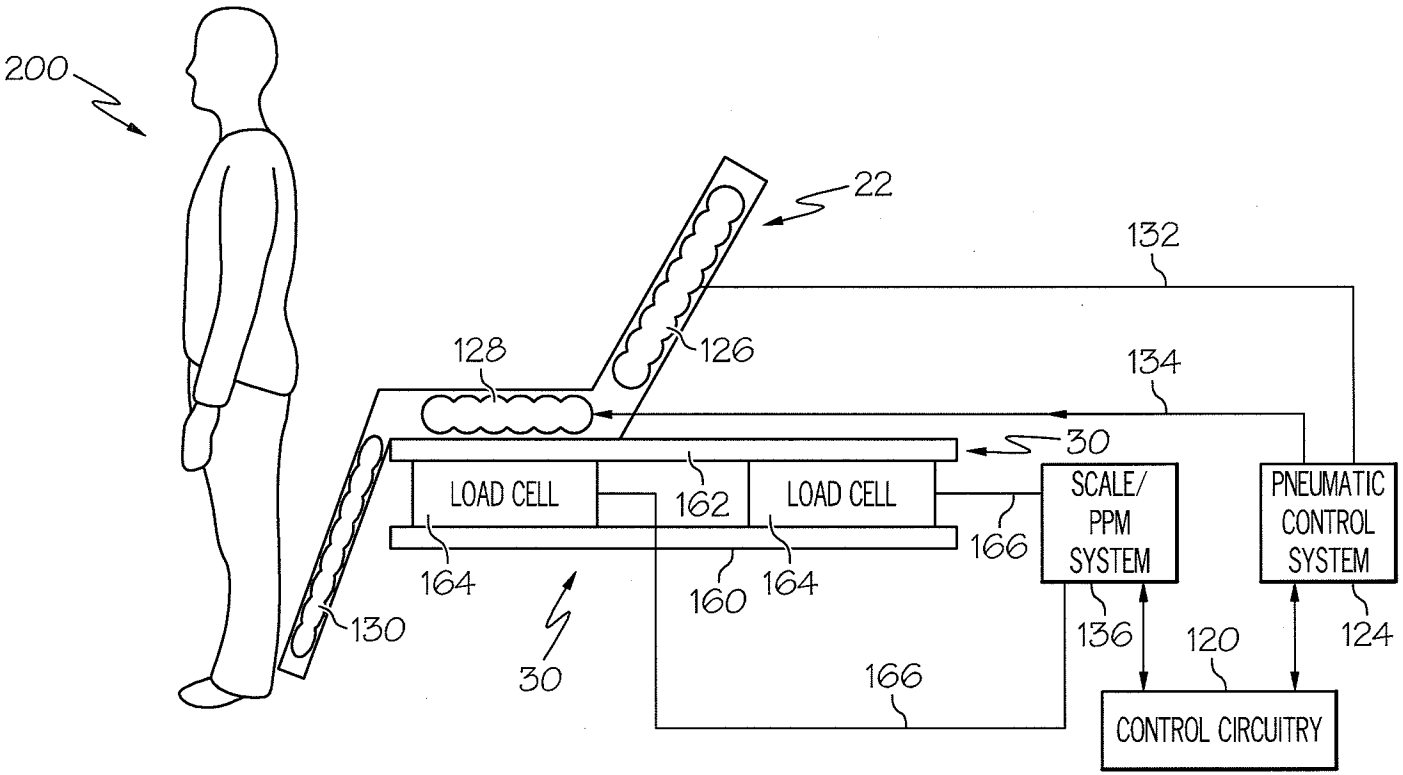
FIG. 13 is a diagrammatic view, similar to FIGS. 11 and 12, showing the one or more bladders of the seat section being re-inflated because the scale/PPM system senses that the patient has egressed from the hospital bed by a sufficient amount.

Referring now to FIGS. 11-13, a further inflation control feature of bed 10 will be described for lighter weight patients 200. Before describing this additional inflation control feature, it is worth noting that upper frame 30 of bed 10, in the illustrative example, includes a lift frame 160 and a weight frame 162 which is supported relative to the lift frame 160 by a set of load cells 164. In FIGS. 11-13, two loads cells 164 are illustrated diagrammatically. However, a common arrangement for hospital beds is to have four load cells arranged at the corners of an imaginary rectangle, for example, and such an arrangement is certainly within the scope of this disclosure. Each of the load cells 164 include a mass of material that deflects under the weight of the load carried by weigh frame 162, and the deflection is sensed by one or more strain gages mounted to the mass of material.

The one or more strain gages of load cells 164 are electrically coupled to the scale/PPM system by lines 166. Thus, the current or voltage sensed on lines 166 correlates to the amount of deflection of load cells 164 and therefore, to the amount of weight supported by load cells 164. By subtracting out the tare weight (i.e., the weight of everything supported by load cells 164 other than the patient), the patient's weight can be determined. Furthermore, based on the individual readings from the load cells, the position of the patient on bed 10 can be determined. See, for example, U.S. Pat. No. 7,253,366 which shows and describes such a scale/PPM system and which is hereby expressly incorporated by reference herein. In some contemplated embodiments, while the patient is supported on bed 10, the signals from the load cells 164 are used to determine a position of the patient's center of gravity relative to a plane passing through the load cells 164. In some embodiments, other types of weight sensors, such as force sensitive resistors (FSR's), capacitive sensors, linear variable displacement transducers (LVDT's), or the like are used in lieu of, or in addition to, load cells 164 to provide signals for determining a patient's weight or position.

As shown in FIG. 11, when a patient is reclining on mattress 22, bladders 128 are inflated. As the patient begins to egress from bed 10 and moves or leans toward the foot end of the seating surface, as shown in FIG. 12, the scale/PPM system 136 senses this movement based on the signals from load cells 164 and bladders 128 are deflated by the pneumatic control system 124. When the patient begins to stand up from bed 10 and transfers weight off of bed 10, as shown in FIG. 13, this is also sensed by the scale/PPM system 136 based on signals from load cells 164 and bladders 128 are re-inflated. By re-inflating bladders 128 as the patient stands up, a softer seating area is created in the event that the patient inadvertently falls back onto the bed 10 during the egress process. This protects the patient from falling back down onto a hard seating surface. Once a threshold amount of time, such as 10 to 30 seconds, after the re-inflation of bladders 128 has elapsed, the bladders 128 are again deflated to ready the bed 10 for the patient's return. Thus, after the threshold amount of time, the patient is assumed to have successfully egressed from the bed 10, is standing up, and is no longer at risk of falling back down onto bed 10.

The deflation, re-inflation, and then re-deflation of bladders 128 just described is contemplated as being a feature of bed 10 that is used with lighter weight patients. For the heavier patients, bladders 128 are already inflated and so if the heavier patients fall back down onto the bed 10 during egress, they will not encounter the type of hard seating surface of the underlying deck sections 42, 43. In some embodiments, the deflation, re-inflation, and then re-deflation of bladders 128 occurs only after chair egress button 69 has been pressed or otherwise activated. In other contemplated embodiments, the deflation, re-inflation, and re-deflation function occurs automatically based on the movement of the patient sensed by the scale/PPM system 136. In still further embodiments, after bladders 128 have been deflated and re-inflated during the egress process, the bladders 128 remain re-inflated for the patient's return to bed 10.

Although certain illustrative embodiments have been described in detail above, many embodiments, variations and modifications are possible that are still within the scope and spirit of this disclosure as described herein and as defined in the following claims.

The invention claimed is:

1. A patient support apparatus comprising a frame including a patient support deck, the patient support deck being movable between a horizontal position to support a patient in a lying position and a chair egress position to support the patient in a sitting position, a lift system operable to support the patient support deck relative to an underlying floor at different heights, and a control system to command operation of the lift system, the control system receiving data indicative of a height of the patient supported on the patient support deck, the control system determining an elevation at which the lift system is to support the patient support deck when the patient support deck is in the chair egress position based on the height of the patient, the elevation correlating to a popliteal height of the patient as determined by the control system based on the height of the patient.

2. The patient support apparatus of claim 1, wherein the frame further comprises a base and an upper frame above the base, the upper frame supports the patient support deck, and the upper frame is supported relative to the base by the lift system.

3. The patient support apparatus of claim 1, wherein the control system includes a user input that is used by a caregiver to indicate the height of the patient.

4. The patient support apparatus of claim 3, wherein the user input comprises a touchscreen display.

5. The patient support apparatus of claim 1, wherein the control system receives data indicative of the height of the patient from a remote computer.

6. The patient support apparatus of claim 5, wherein the control system receives the data indicative of the height of the patient from the remote computer via at least one of a wired datalink and a wireless datalink.

7. The patient support apparatus of claim 1, wherein the control system commands the lift system to support the patient support deck in the chair egress position at a higher elevation for taller patients and at a lower elevation for shorter patients.

8. The patient support apparatus of claim 1, further comprising a mattress supported on the patient support deck, the mattress having at least one inflatable bladder in a region of the mattress that supports the patient's buttocks when the patient support deck is in the chair egress position supporting the patient in the sitting position, the control system including a pneumatic control system portion operable to inflate and deflate the at least one inflatable bladder, and the control system determining whether to deflate the at least one inflatable bladder when the patient support deck is in the chair egress position based on a weight of the patient.

9. The patient support apparatus of claim 8, wherein the frame includes at least one sensor that provides a signal to the control system indicative of the weight of the patient.

10. The patient support apparatus of claim 9, wherein the sensor comprises at least one load cell.

11. The patient support apparatus of claim 8, wherein the control system receives data indicative of the weight of the patient from a remote computer.

12. The patient support apparatus of claim 11, wherein the control system receives the data indicative of the weight of the patient from the remote computer via at least one of a wired datalink and a wireless datalink.

13. The patient support apparatus of claim 8, wherein the control system determines whether to further inflate the at least one inflatable bladder when the patient support deck is in the chair egress position based on the weight of the patient.

14. The patient support apparatus of claim 13, wherein the at least one inflatable bladder is deflated when the patient support deck is in the chair egress position supporting the patient in the sitting position if the patient's weight is below a threshold amount of weight and the at least one inflatable bladder is further inflated when the patient support deck is in the chair egress position supporting the patient in the sitting position if the patient's weight is above the threshold amount of weight.

15. The patient support apparatus of claim 8, wherein the control system includes a patient position monitoring system to monitor a position of the patient on the patient support deck and the control system determines whether to deflate the at least one inflatable bladder when the patient support deck is in the chair egress position based on the weight of the patient and based on the position of the patient.

16. The patient support apparatus of claim 15, wherein if the weight of the patient is below a threshold weight, then the control system signals the pneumatic control system portion to maintain inflation of the at least one inflatable bladder if the patient position monitoring system indicates that the patient is reclined on the patient support deck when the patient support deck is in the chair egress position and wherein if the weight of the patient is below the threshold weight, then the control system signals the pneumatic control system portion to deflate the at least one inflatable bladder if the patient position monitoring system indicates that the patient is moving toward egressing from the patient support deck when the patient support deck is in the chair egress position.

17. The patient support apparatus of claim 16, wherein if the weight of the patient is below the threshold angle, then the control system signals the pneumatic control system portion to re-inflate the at least one inflatable bladder after the patient has egressed from the patient support deck by a threshold amount as determined by the patient position monitoring system.

18. A patient support apparatus comprising a frame including a patient support deck, the patient support deck being movable between a horizontal position to support a patient in a lying position and a chair egress position to support the patient in a sitting position, a lift system operable to support the patient support deck relative to an underlying floor at different heights, and a control system to command operation of the lift system, the control system receiving data relating to a popliteal height of the patient supported on the patient support deck, the control system determining an elevation at which the lift system is to support the patient support deck when the patient support deck is in the chair egress position based on the popliteal height of the patient.

19. The patient support apparatus of claim 18, wherein the control system includes a user input that is used by a caregiver to indicate a height of the patient, the control system determining the popliteal height of the patient based on the height of the patient indicated by the caregiver using the user input.

20. The patient support apparatus of claim 18, wherein the control system receives data indicative of a height of the patient from a remote computer, the control system determining the popliteal height of the patient based on the height of the patient received from the remote computer.

21. The patient support apparatus of claim 18, wherein the control system receives data indicative of the popliteal height of the patient from a remote computer.

* * * * *